US006559735B1

(12) United States Patent
Hoang et al.

(10) Patent No.: US 6,559,735 B1
(45) Date of Patent: May 6, 2003

(54) DUPLEXER FILTER WITH AN ALTERNATIVE SIGNAL PATH

(75) Inventors: Truc Hoang, San Jose, CA (US); Reddy Vangala, Albuquerque, NM (US)

(73) Assignee: CTS Corporation, Elkhart, IN (US)

( * ) Notice: Subject to any disclaimer, the term of this patent is extended or adjusted under 35 U.S.C. 154(b) by 0 days.

(21) Appl. No.: 09/702,420

(22) Filed: Oct. 31, 2000

(51) Int. Cl.[7] ..... H01P 1/213; H01P 1/203
(52) U.S. Cl. ..... 333/134; 333/202; 333/206
(58) Field of Search ..... 333/134, 206, 333/202

(56) References Cited

U.S. PATENT DOCUMENTS

| | | | | | |
|---|---|---|---|---|---|
| 4,740,765 | A | * | 4/1988 | Ishikawa et al. | 333/206 |
| 4,742,562 | A | | 5/1988 | Kommrusch | 455/78 |
| 4,800,347 | A | * | 1/1989 | Yorita et al. | 333/202 |
| 4,823,098 | A | | 4/1989 | DeMuro et al. | 333/206 |
| 4,965,537 | A | | 10/1990 | Kommrusch | 333/202 |
| 5,004,992 | A | | 4/1991 | Grieco et al. | 333/202 |
| 5,055,808 | A | | 10/1991 | Walker et al. | 333/207 |
| 5,109,536 | A | | 4/1992 | Kommrusch | 455/82 |
| 5,162,760 | A | | 11/1992 | Phillips et al. | 333/206 |
| 5,198,788 | A | | 3/1993 | Phillips et al. | 333/207 |
| 5,208,565 | A | * | 5/1993 | Sogo et al. | 333/206 |
| 5,379,011 | A | | 1/1995 | Sokola et al. | 333/206 |
| 5,572,175 | A | * | 11/1996 | Tada et al. | 333/206 |
| 5,602,518 | A | | 2/1997 | Clifford et al. | 333/202 |
| 5,721,520 | A | | 2/1998 | McVeety et al. | 333/202 |
| 5,769,988 | A | | 6/1998 | Kagata et al. | 264/620 X |
| 5,783,978 | A | | 7/1998 | Noguchi et al. | 333/202 |
| 5,864,264 | A | * | 1/1999 | Hino | 333/206 |
| 5,952,900 | A | | 9/1999 | Hoang et al. | 333/206 |
| 5,959,511 | A | | 9/1999 | Pasco et al. | 333/206 |
| 5,994,978 | A | | 11/1999 | Vangala | 333/134 |

FOREIGN PATENT DOCUMENTS

| | | | | |
|---|---|---|---|---|
| EP | 0480703 A2 | | 10/1991 | |
| EP | 798803 A2 | | 3/1997 | |
| JP | 239001 | * | 10/1991 | 333/202 DB |
| JP | 252201 | * | 11/1991 | 333/202 DB |
| WO | WO93/009071 | | 5/1993 | |

* cited by examiner

*Primary Examiner*—Benny Lee
(74) *Attorney, Agent, or Firm*—David K. Lucente; Steven Weseman

(57) ABSTRACT

The present invention is a preferred monoblock ceramic bandpass duplexer filter. The preferred filter has at least three I/O pads. One of the pads is coupled to an antenna, another is connected to a transmission circuit and the last pad is connected to a receive circuit. The filter is comprised of two sections: a transmission section and a receive section. The transmission and receive sections include resonators disposed on respective sides of the antenna pad. A first alternative signal path is disposed adjacent the ends of the transmission resonators. A second alternative signal path is disposed adjacent to the ends of the receive resonators. Each alternative signal path couples adjacent and non-adjacent resonators. A further feature of the filter of the present invention includes a shunt zero resonator for the transmission section. To the contrary, the present invention allows the elimination of a shunt zero resonator for the receive section of the filter.

7 Claims, 6 Drawing Sheets

DUPLEXER FILTER WITH AN ALTERNATIVE SIGNAL PATH

FIELD OF THE INVENTION

This invention relates to electrical filters and, in particular, to dielectric filters that provide increased attenuation proximate to the desired passband.

BACKGROUND OF THE INVENTION

Ceramic block filters offer several advantages over lumped component filters. The blocks are relatively easy to manufacture, rugged, and relatively compact. In the basic ceramic block filter design, the resonators are formed by cylindrical passages, called holes, extending through the block from the long narrow side to the opposite long narrow side. The block is substantially plated with a conductive material (i.e. metallized) on all but one of its six (outer) sides and on the inside walls formed by the resonator holes.

One of the two opposing sides containing holes is not fully metallized, but instead bears a metallization pattern designed to couple input and output signals through the series of resonators. This patterned side is conventionally labeled the top of the block. In some designs, the pattern may extend to sides of the block, where input/output electrodes are formed.

The reactive coupling between adjacent resonators is dictated, at least to some extent, by the physical dimensions of each resonator, by the orientation of each resonator with respect to the other resonators, and by aspects of the top surface metallization pattern. Interactions are complex and difficult to predict. These These filters may also be equipped with an external metallic shield attached to and positioned across the open-circuited end of the block in order to cancel parasitic coupling between non-adjacent resonators and to achieve acceptable stopbands.

Although such RF signal filters have received widespread commercial acceptance since the 1970s, efforts at improvement on this basic design continued.

In the interest of allowing wireless communication providers to provide additional service, governments worldwide have allocated new higher RF frequencies for commercial use. To better exploit these newly allocated frequencies, standard setting organizations have adopted bandwidth specifications with compressed transmit and receive bands as well as individual channels. These trends are pushing the limits of filter technology to provide sufficient frequency selectivity and band isolation.

Coupled with the higher frequencies and crowded channels are the consumer market trends towards ever smaller wireless communication devices (e.g. handsets) and longer battery life. Combined, these trends place difficult constraints on the design of wireless components such as filters. Filter designers may not simply add more space-taking resonators or allow greater insertion loss in order to provide improved signal rejection.

Therefore, the need continues for improved RF filters which can offer selectivity and other performance improvements, without increases in size or cost of manufacturing. This invention overcomes the size-to-selectivity compromise by providing a ceramic block RF filter having adaptable selectivity with a robust, relatively low cost control mechanism and relatively low insertion loss.

SUMMARY OF THE INVENTION

The present invention is a preferred duplexer filter that is a monolith (also referred to as a monoblock) of a dielectric ceramic that defines a plurality of resonators. The preferred filter has at least three input/output (I/O) pads. One of the pads is coupled to an antenna, another is connected to a transmission circuit and the last pad is connected to a receive circuit. The filter is comprised of two sections: a transmission section and a receive section. The transmission and receive sections include resonators disposed on respective sides of the antenna pad.

The filter of the invention also includes a first alternative signal path adjacent the ends of the transmission resonators. A second alternative signal path is disposed adjacent to the ends of the resonators. Each alternative signal path couples adjacent and non-adjacent resonators. A further feature of the filter of the present invention includes a shunt zero resonator for the transmission section. To the contrary, the present invention allows the elimination of a shunt zero resonator for the received section of the filter.

Specified more generally, a preferred RF signal filter according to the present invention includes a block of dielectric material having an input electrode and an output electrode spaced apart along the length of the block. The block defines an array of through-hole resonators extending between the input electrode and the output electrode. A resonator by-pass electrode extends from a position adjacent a first resonator of the array to a position adjacent a second resonator of the array. The first and second resonators are separated by at least one resonator of the array such that the by-pass electrode provides a parallel signal pathway between the first and second resonators.

There are other advantages and features of this invention which will be more readily apparent from the following detailed description of the preferred embodiment of the invention, the drawings, and the appended claims.

BRIEF DESCRIPTION OF THE FIGURES

In the FIGURES.

DETAILED DESCRIPTION OF THE PREFERRED EMBODIMENT

While this invention is susceptible to embodiment in many different forms, this specification and the accompanying drawings disclose only preferred forms as examples of the invention. The invention is not intended to be limited to the embodiments so described, however. The scope of the invention is identified in the appended claims.

Figure 1:
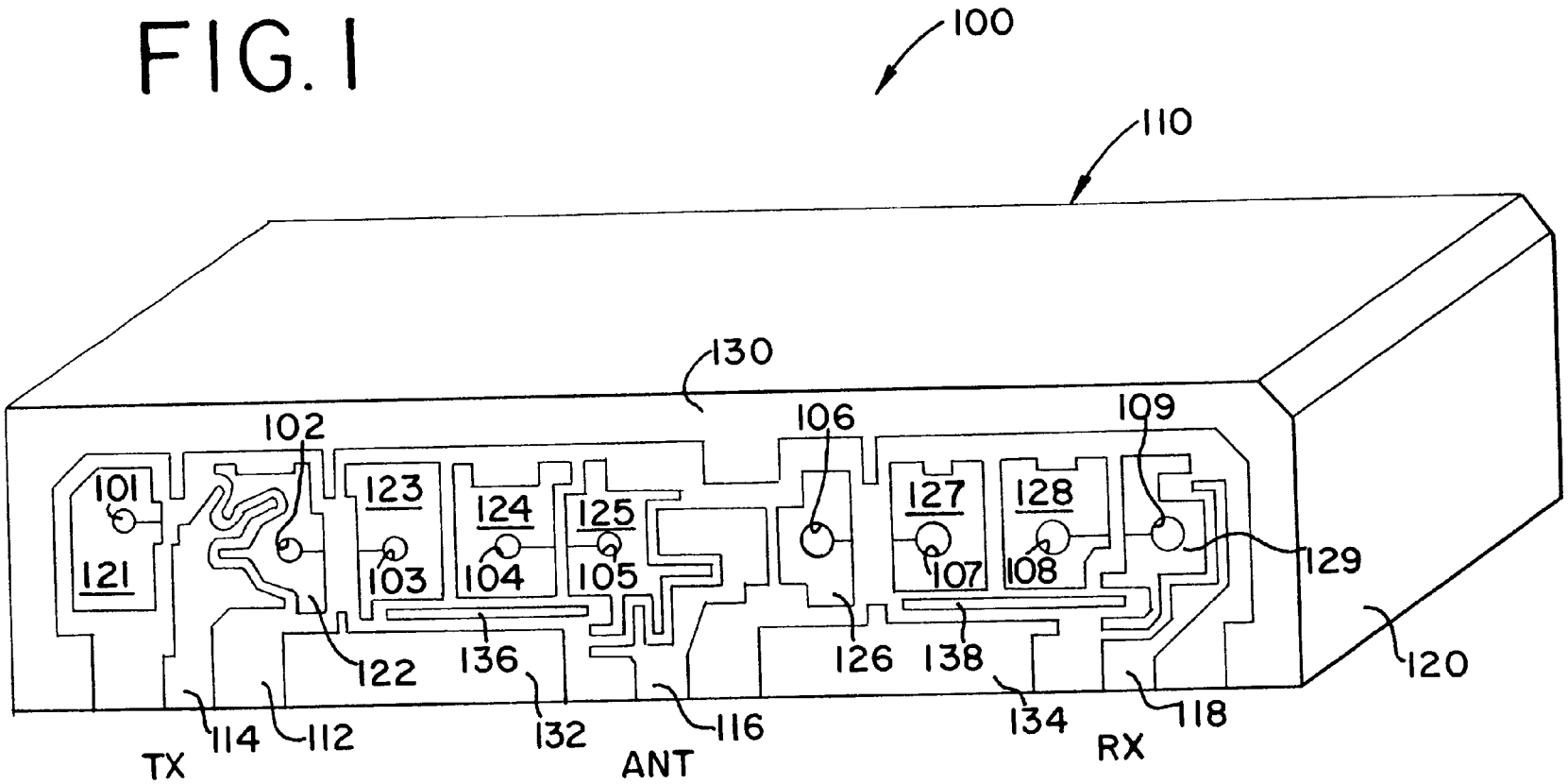
FIG. 1 is a perspective view of a filter incorporating the present invention.

Referring to FIG. 1, the preferred embodiment of a filter 100 is shown. Filter 100 includes a block 110 which is comprised of a dielectric material that is selectively plated with a conductive material. Block 110 has a top surface 112, a bottom (not separately shown) and sides, such as side 120. The filter 100 can be constructed of a suitable dielectric material that has a low loss, a high dielectric constant and a low temperature coefficient of the dielectric constant.

The plating on block 110 is electrically conductive, preferably copper, silver or an alloy thereof. Such plating preferably covers all surfaces of the block 110 with the exception of a top surface 112, the plating of which is described below. Of course, other conductive plating arrangements can be utilized. See, for example, those discussed in "Ceramic Bandpass Filter," U.S. Pat. No. 4,431,977, Sokola et al., assigned to the present assignee and incorporated herein by reference to the extent it is not inconsistent. The plating is preferably coupled to a reference potential.

Block 110 includes nine holes 101, 102, 103, 104, 105, 106, 107, 108 and 109 (101–109), each extending from top surface 112 to a bottom surface (not shown) thereof. The surfaces defining holes 101–109 are likewise plated with an electrically conductive material. Each of the plated holes 101–109 is essentially a transmission line resonator comprised of a short-circuited coaxial transmission line having a length selected for desired filter response characteristics. For an additional description of the holes 101–109, reference may be made to U.S. Pat. No. 4,431,977, Sokola et al., supra. Although block 110 is shown with nine plated holes 101–109, the present invention is not limited to such. In fact, any number of plated holes greater than two can be utilized depending on the filter response characteristics desired.

According to the present invention, top surface 112 of block 110 is selectively plated with an electrically conductive material similar to the plating on block 110. The selective plating includes input-output I/O pads, specifically transmit (Tx) electrode 114, antenna (ANT) electrode 116 and receive (Rx) electrode 118. Also included is plating 121, 122, 123, 124, 125, 126, 127, 128 and 129 (121–129) that surrounds holes 101–109 and ground plating 130, 132 and 134. Finally, according to the present invention, alternative signal paths 136 and 138 are included in the selective plating on top surface 112.

Plating 121–129 is used to capacitively couple the transmission line resonators, provided by the plated holes 101–109, to ground plating 130, 132, 134 on top surface 112 of block 110. Portions of plating 121–129 also couple the associated resonator of holes 101–109 to transmit electrode 114, antenna electrode 116 and receive electrode 118. Furthermore, alternative signal paths 136, 138 couple adjacent and non-adjacent proximate resonators of holes 101–109 through associated plating 121–129. Plates 121–125, holes 101–105, ground plating 132, alternative signal path 136 and transmit electrode 114 together make up a transmit section of duplexer filter 100. Plates 126–129, holes 106–109, ground plating 134, alternative signal path 138 and receiver electrode 118 together make up a receive section of filter 100.

Coupling between the transmission line resonators, provided by the plated holes 101–109 in FIG. 1, is accomplished at least in part through the dielectric material of block 110 and is varied by varying the width of the dielectric material and the distance between adjacent transmission line resonators. The width of the dielectric material between adjacent holes 101–109 can be adjusted in any suitable regular or irregular manner, such as, for example, by the use of slots, cylindrical holes, square or rectangular holes, or irregular shaped holes. Furthermore, plated or unplated holes located between the transmission line resonators 101–109 can also be utilized for adjusting the coupling.

In addition, the plating 121–129 causes capacitive coupling between adjacent holes 101–109. In light of that, the non-linear periphery of plates 121–129 is chosen to increase the capacitive coupling. Since capacitive coupling is also a function of distance, the periphery of plates 121–129 can be moved closer to the other plate of the capacitive coupling. As a result, if desired, the periphery can be made more linear. Such alteration of the periphery and distance is determined from the desired coupling.

Figure 2:
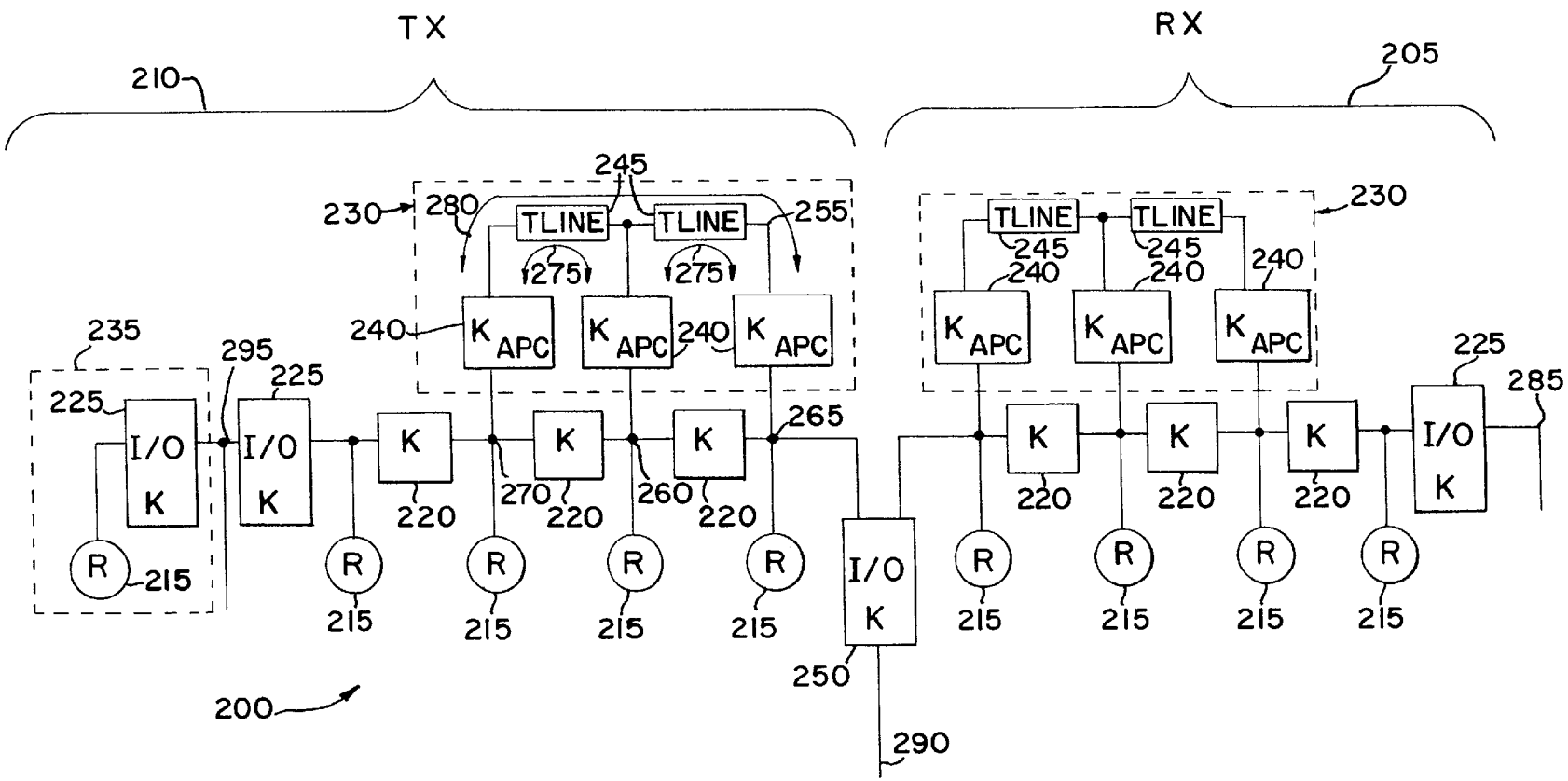
FIG. 2 is a block schematic for the FIG. 2 filter.

This coupling between the transmission line resonators is shown diagrammatically in FIG. 2. Circuit 200 represents a partial circuit model of filter 100 in FIG. 1. Circuit (or filter) 200 includes a transmitter (Tx) section 210 and a receiver (Rx) section 205. Both sections 205 and 210 include resonators (R) 215, inter-resonator couplings (K) 220, I/O couplings 225 and alternative signal paths 230. Inter-resonator couplings 220 represent the capacitive coupling between plates 121–129 (of FIG. 1). I/O couplings 225 represent capacitive coupling between transmit electrode 114, antenna electrode 116 and receive electrode 118, and plating 121–129 (of FIG. 1). Transmitter section 210 additionally includes a shunt zero 235, which includes a resonator 215 and an I/O coupling 225. Sections 205 and 210 are coupled to a preferred antenna through I/O coupling 250.

Alternative signal paths 230 each include, as shown, alternative path couplings 240 and transmission lines (TLINE) 245. Alternative path couplings (KAPc) 240 represent the capacitive coupling between plating 121–129 and alternative signal paths 136, 138 (of FIG. 1). Couplings 240 and lines 245 electrically couple resonators 215 in parallel. To illustrate this parallel coupling, a resonator 215 is coupled through node 265 and a coupling 240 to node 255. Node 255 is coupled in parallel through line 245, coupling 240 and node 260 to a second resonator 215, and through lines 245, coupling 240 and node 270 to a third resonator 215.

In a different perspective, nodes 260 and 265 are directly coupled as shown by a path line 275. Path line 275 traverses couplings 240 and line 245. In addition, nodes 265 and 270 are directly coupled as shown by path line 280. Path line 275 traverses couplings 240 and lines 245. Thus, according to the present invention, alternative signal paths 236, 238 provide additional coupling among resonators 215. With the use of either alternative signal paths 230 (136 and 138 in FIG. 1), adjacent and non-adjacent resonators 215 that are proximate to said paths are coupled together.

Operationally, if node 285 provides a received signal as an output, lead 290 is coupled to an antenna and node 295 receives a transmit signal, then circuit 200 of FIG. 2 has transmitter section 210 exhibiting a four-pole passband generated by resonators 215, three transmission zeroes generated by alternative signal path 230 proximate to resonators 215, a shunt zero generated by shunt zero 235 and an alternative path zero generated by alternative signal path 235. Receiver section 205 has a four-pole passband generated by resonators 215, three transmission zeroes generated by alternative signal path 230 proximate to resonators 215 and an alternative path zero generated by alternative signal path 236.

Figure 5:
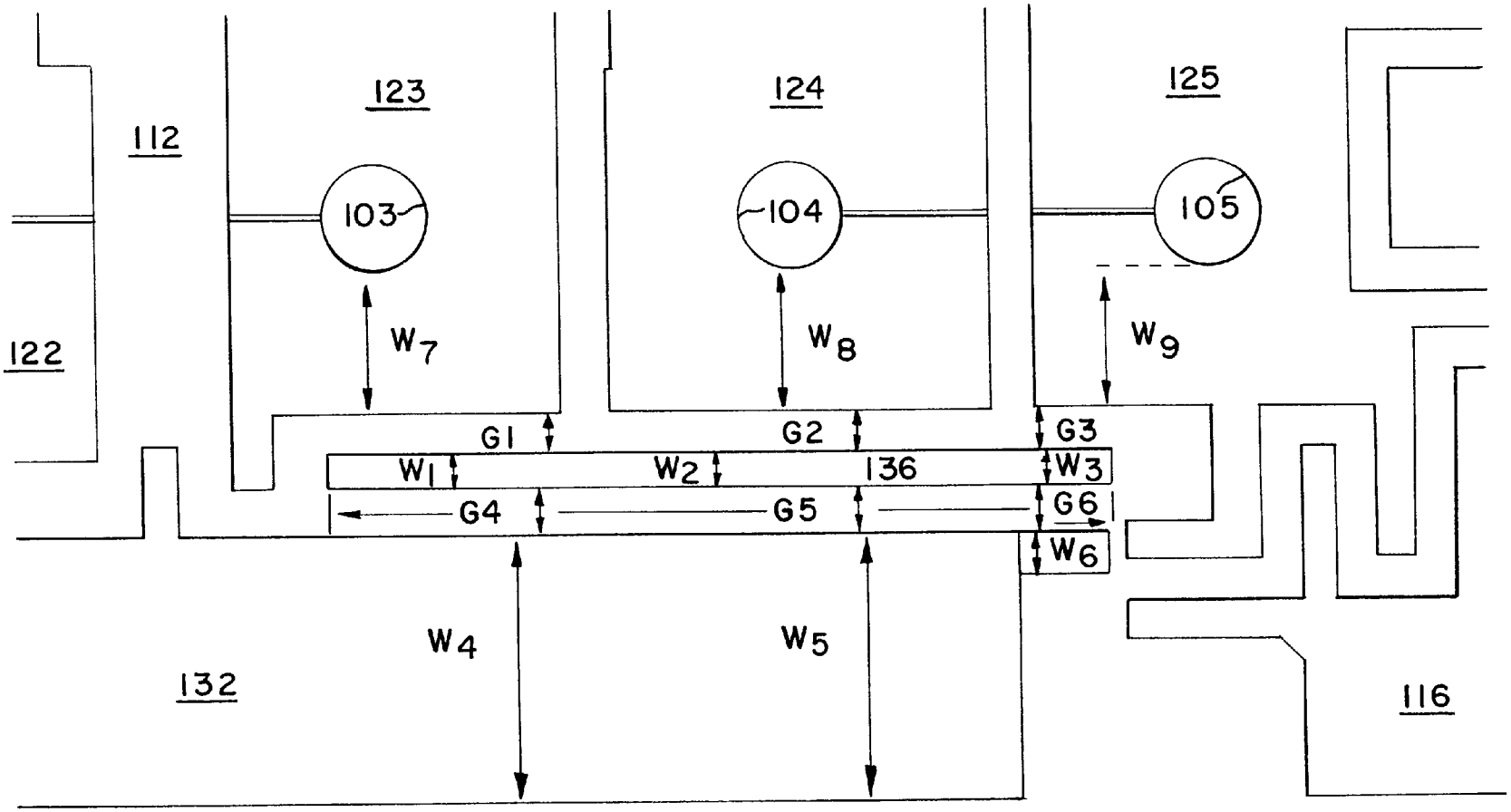
FIG. 5 is an enlarged fragmentary plan view of the transmitter section of the dielectric block filter of FIG. 2 with markings for specifying preferred dimensions.

FIG. 5 is an enlarged fragmentary plan view of the transmitter section of the top of the dielectric block filter of FIG. 2 with markings W, G, and L for specifying preferred dimensions. The following corresponding list defines the preferred dimensions (in mils or 0.001") of electrodes and spaces about the transmitter alternative signal path for an 1800 Mhz PCS duplexer:

$3 \leqq W_1, W_2, W_3 \leqq 12$ $3 \leqq G_1, G_2, G_3 \leqq 15$ $3 \leqq G_4, G_5, G_6 \leqq 15$ $50 \leqq L_1 \leqq 500$ $10 \leqq \text{Block } E_R \leqq 120$ $3 \leqq W_4, W_5, W_6 \leqq 60$ $1 \leqq W_7, W_8, W_9 \leqq 60$ These dimensions are preferred for a US PCS duplexer (1800 Mhz) having an overall length of about 19.5 mm, an overall width of about 4 mm, and an overall height of 7.25 mm.

Figure 6:
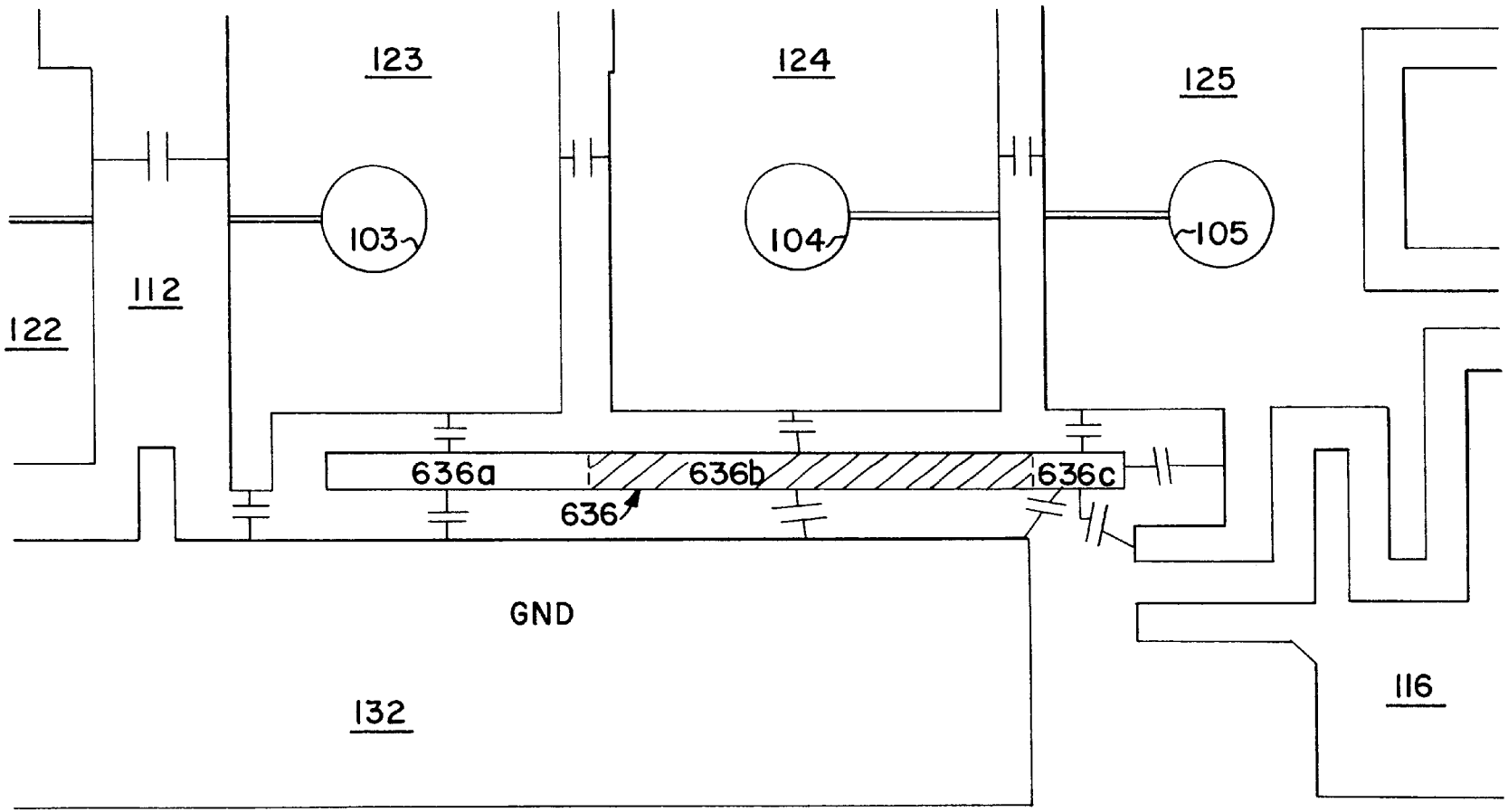
FIG. 6 is an enlarged fragmentary plan view of the transmitter section of a dielectric block filter according to an alternate embodiment of the present invention.

FIG. 6 shows a modification of transmitter alternative signal path 136 of FIG. 1. Bar 636 is comprised of three portions 636*a*, 636*b* and 636*c* as shown. For this modification, each of those three portions is composed of a different composition. This in turn will provide a method(of varying the coupling between the portions of bar 636 and proximate plates 123, 124 and 125.

Although the present invention is exemplified by a monoblock structure, duplexer ceramic bandpass filter described above, many variations exist that are contemplated to be within the present invention. To illustrate, a filter having only a receive or transmit section can utilize the present invention. Also, whether the filter is a duplexer or not, the number of holes should be at least three. If desired, a shunt zero resonator can be added to the receive section of the filter.

The present invention can be used with structures that separately formed resonators that are then used as a band pass or band stop filter. An alternative signal path can be formed by using discrete components between each separate resonator. However, if the resonators are connected, then the alternative signal path may be disposed as described for the preferred embodiment.

For both alternative signal paths, the geometry can be changed. To illustrate, each bar can be configured in a U-shape, an L-shape, a convex or concave arc, or with a nonlinear periphery like a zigzag, an undulation, a wave or a comb. Furthermore, the configuration can be changed for portions of the bar, while other portions have a different configuration. As stated above, the bar can include portions having different compositions. Any configuration may be considered to achieve the desired coupling. In addition, the alternative signal path can be comprised of metallization and discrete components. Such components can be wires, capacitors, resistors and inductors.

Moreover, the present invention can utilize more than one alternative signal path for the transmit or receive sections. To illuminate, another alternative signal path can be placed adjacent to plates 123, 124 and 125 on the opposite side of alternative signal path 136 in FIG. 1. Or the other alternative signal path can be placed adjacent to plates 122,123 and 124 on the opposite side of alternative signal path 136. A similar additional alternative signal path can be placed in the receive section of filter 100.

Working Example

A ceramic duplexer filter for US PCS was fabricated as shown in in FIG. 1 for testing and comparison. The prepared FIG. 1 duplexer included a shield in accordance with the disclosure of U.S. Pat. No. 5,745,018 to Vangala, which is herein incorporated by reference to the extent it is not inconsistent. The frequency response of the improved duplexer about the US PCS transmit and receive bands was graphed together with a conventional duplexer designed for the same frequencies.

Figure 3:
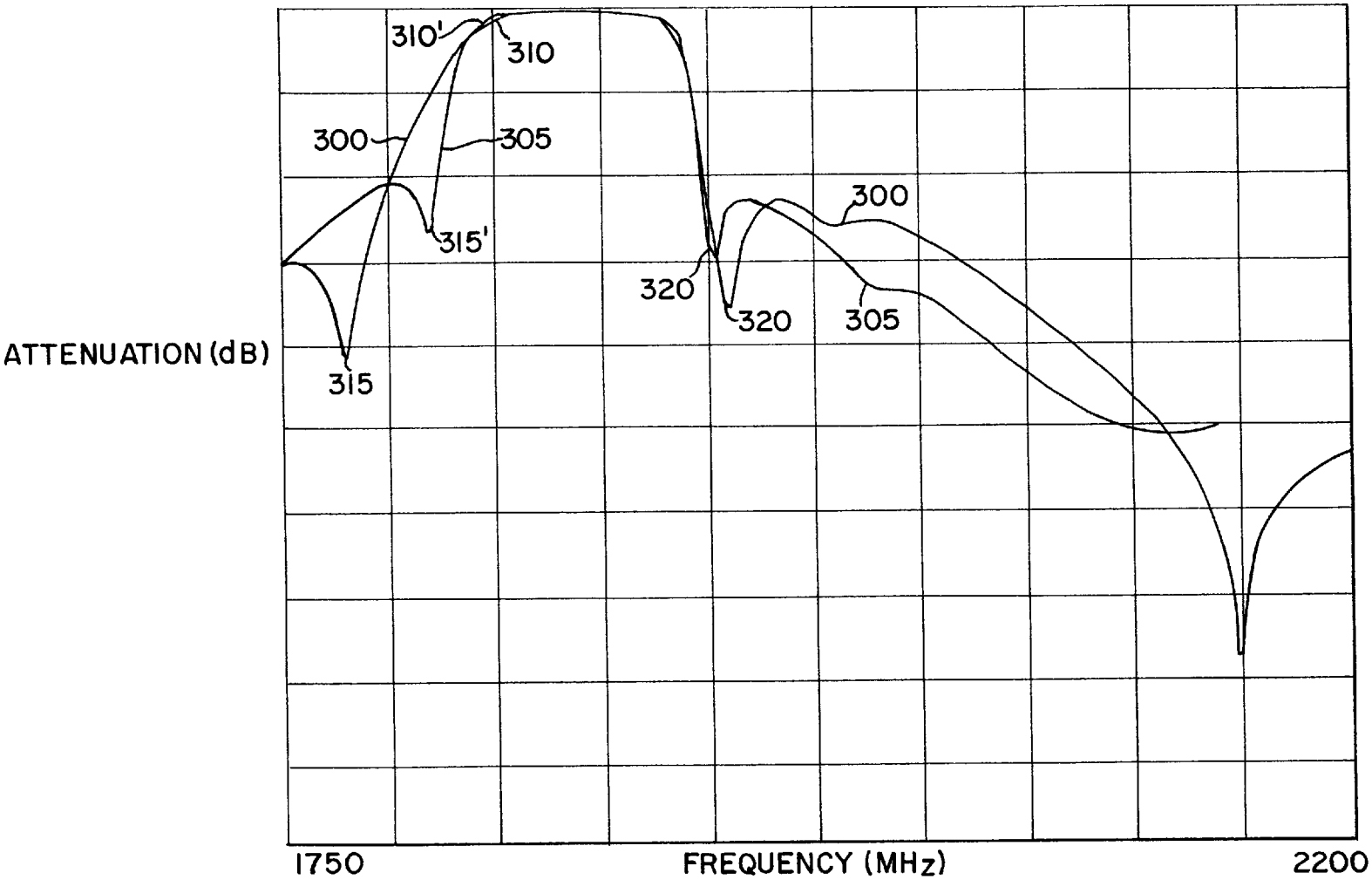
FIG. 3 is a frequency response graph for RF signals around a U.S. PCS transmit band showing the performance of a ceramic duplexer filter according to the present invention and the performance of a conventional duplexer.

FIG. 3 is a frequency response graph for RF signals around a U.S. PCS transmit band showing the performance of a ceramic duplexer filter according to the present invention and the performance of a conventional duplexer A line 300 shows the transmit band performance of the conventional duplexer filter, i.e. without an alternative signal path 136. The conventional transmitter section provides a passband 310, a low-side zero 315 and a high-side zero 320. Line 305 is the transmit band response of the improved duplexer which includes a alternative signal path 136. Zeroes 315 and 320 are shifted to 315' and 320' to provide zeroes closer to passband 310'. Note that the associated passband 310' extends over a greater range of frequency with a flatter attenuation curve than passband 310. The advantages of the present invention can be seen from the graph in FIG. 3. The use of the present invention provides better attenuation closer to the passband than a filter without the present invention.

Figure 4:
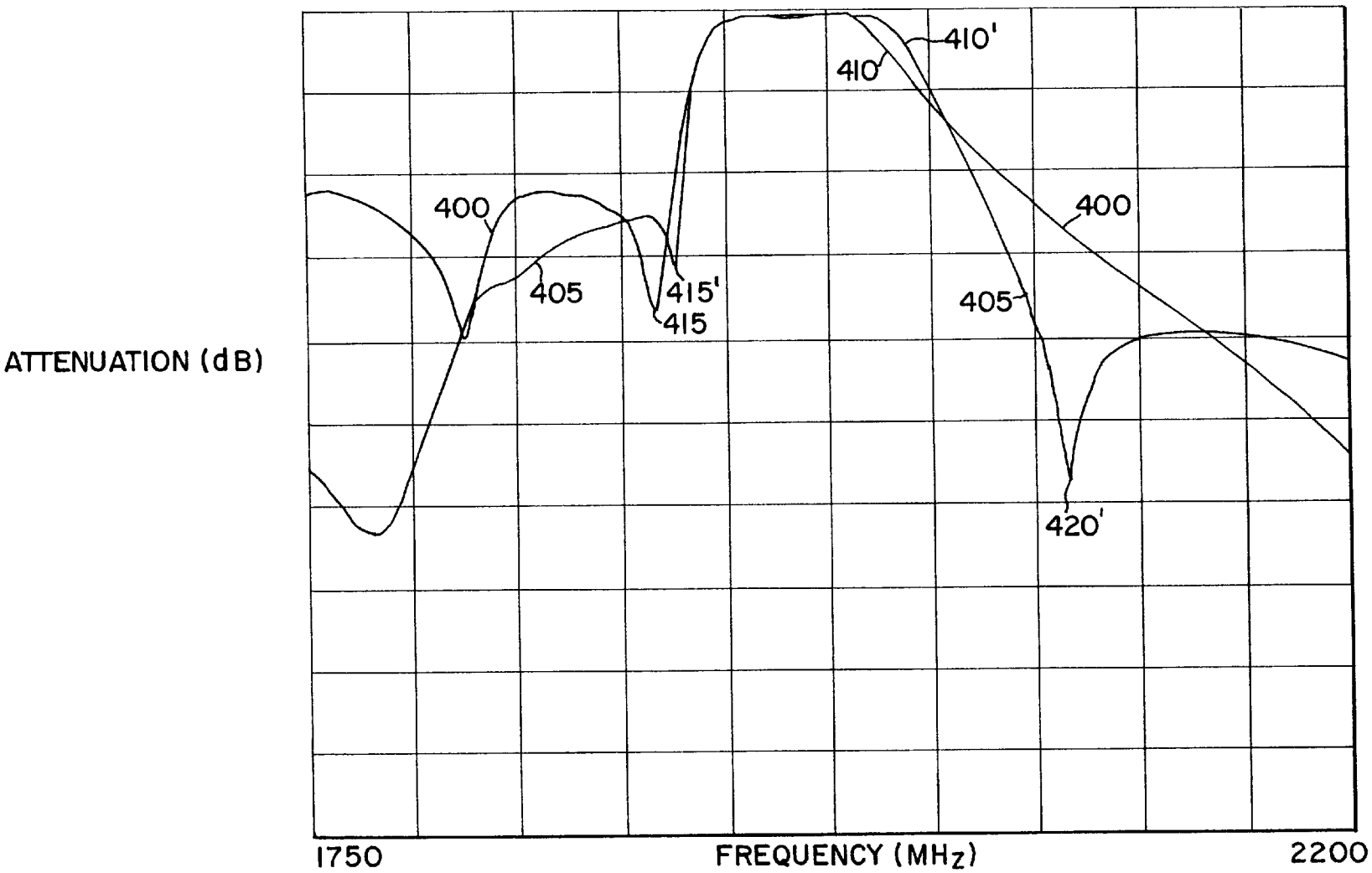
FIG. 4 is a frequency response graph for RF signals around a U.S. PCS receive band showing the performance of a ceramic duplexer filter according to the present invention and the performance of a conventional duplexer.

FIG. 4 is a frequency response graph for RF signals around a U.S. PCS receive band showing the performance of a ceramic duplexer filter according to the present invention and the performance of a conventional duplexer. Line 400 is the receive bandfrequency response of the conventional duplexer, i.e. without a duplexer filter without alternative signal path. The represented receiver portion has a passband 410, a low-side zero 415 and a high-side zero that extends off the graph. Line 405 shows the performance provided by the receiver section of the improved PCS duplexer filter according to the present invention. Zero 415 and the high-side zero are moved to 415' and 420' to provide zeroes closer to passband 410'. Note that the associated passband 410' extends over a greater range of frequency than passband 410. Thus, the use of the present invention provides better attenuation closer to the passband than a filter without the present invention.

Numerous variations and modifications of the embodiments described above may be effected without departing from the spirit and scope of the novel features of the invention. No limitations with respect to the specific system illustrated herein are intended or should be inferred. It is, of course, intended to cover by the appended claims all such modifications as fall within the scope of the claims.

We claim:

1. A monoblock duplexer filter adapted for connection to an antenna, a transmitter and a receiver for filtering an incoming signal from the antenna to the receiver and for filtering an outgoing signal from the transmitter to the antenna, the duplexer filter comprising a parallelepiped dielectric block having a top, a bottom and four sides, and including:

an antenna electrode pad on the block;

a transmit section extending between the antenna electrode and a first side of the block;

a receive section extending between the antenna electrode and a second side of the block opposing the first side;

each section having a plurality of through-hole resonators, each through-hole resonator extending between the top and the bottom;

a transmit electrode pad on the block and spaced apart from the antenna electrode along the length of the block and positioned in the transmit section;

a receive electrode pad on the block and spaced apart from the antenna electrode along the length of the block and positioned in the receiver section;

an isolated resonator by-pass electrode plating on the top in the transmit section and extending from a position adjacent a first resonator of the plurality of through-hole resonators to a position adjacent a second resonator of the plurality of through-hole resonators, the first and second resonators being separated by at least one resonator therebetween; and a second isolated resonator by-pass electrode plating on the top in the receive section and extending from a position adjacent a third resonator of the plurality of through-hole resonators to a position adjacent a fourth resonator of the plurality of through-hole resonators in the receive section, the third and fourth resonators being separated by at least one resonator therebetween.

2. A monoblock duplexer filter adapted for connection to an antenna, a transmitter and a receiver for filtering an incoming signal from the antenna to the receiver and for filtering an outgoing signal from the transmitter to the antenna, the duplexer filter comprising a parallelepiped dielectric block having a top, a bottom and four sides, and including:

an antenna electrode pad on the block;

a transmit section extending between the antenna electrode and a first side of the block;

a receive section extending between the antenna electrode and a second side of the block opposing the first side;

each section having a plurality of through-hole resonators, each through-hole resonator extending between the top and the bottom;

a transmit electrode pad on the block and spaced apart from the antenna electrode along the length of the block and positioned in the transmit section;

a receive electrode pad on the block and spaced apart from the antenna electrode along the length of the block and positioned in the receiver section; and an isolated resonator by-pass electrode plating on the top in the transmit section and extending from a position adjacent a first resonator of the plurality of through-hole resonators to a position adjacent a second resonator of the plurality of through-hole resonators, the first and second resonators being separated by at least one resonator therebetween, wherein at least one of the plurality of resonators of the transmit section is a shunt zero resonator which is positioned between the first side of the block and the transmit electrode pad.

3. A monoblock duplexer filter adapted for connection to an antenna, a transmitter and a receiver for filtering an incoming signal from the antenna to the receiver and for filtering an outgoing signal from the transmitter to the antenna, the duplexer filter comprising a parallelepiped dielectric block having a top, a bottom and four sides, and including:

an antenna electrode pad on the block;

a transmit section extending between the antenna electrode and a first side of the block;

a receive section extending between the antenna electrode and a second side of the block opposing the first side;

each section having a plurality of through-hole resonators, each through-hole resonator extending between the top and the bottom;

a transmit electrode pad on the block and spaced apart from the antenna electrode along the length of the block and positioned in the transmit section;

a receive electrode pad on the block and spaced apart from the antenna electrode along the length of the block and positioned in the receiver section; and an isolated resonator by-pass electrode plating on the top in the transmit section and extending from a position adjacent a first resonator of the plurality of through-hole resonators to a position adjacent a second resonator of the plurality of through-hole resonators, the first and second resonators being separated by at least one resonator therebetween, wherein the by-pass electrode plating is elongate and rectangular in shape.

4. The filter according to claim 3 having nine through-hole resonators.

5. The filter according to claim 3 wherein the transmit section includes five through-hole resonators and the receive section includes four through-hole resonators.

6. A monoblock duplexer filter adapted for connection to an antenna, a transmitter and a receiver for filtering an incoming signal from the antenna to the receiver and for filtering an outgoing signal from the transmitter to the antenna, the duplexer filter comprising a parallelepiped dielectric block having a top, a bottom and four sides, and including:

an antenna electrode pad on the block;

a transmit section extending between the antenna electrode and a first side of the block;

a receive section extending between the antenna electrode and a second side of the block opposing the first side;

each section having a plurality of through-hole resonators, each through-hole resonator extending between the top and the bottom;

a transmit electrode pad on the block and spaced apart from the antenna electrode along the length of the block and positioned in the transmit section;

a receive electrode pad on the block and spaced apart from the antenna electrode along the length of the block and positioned in the receiver section; and an isolated resonator by-pass electrode plating on the top in the receive section and extending from a position adjacent a first resonator of the plurality of through-hole resonators to a position adjacent a second resonator of the plurality of through-hole resonators, the first and second resonators being separated by at least one resonator therebetween, wherein the by-pass electrode plating is elongate and rectangular in shape.

7. A monoblock duplexer filter adapted for connection to an antenna, a transmitter and a river for filtering an incoming signal from the antenna to the receiver and for filtering an outgoing signal from the transmitter to the antenna, the duplexer filter comprising a monolithic, parallelepiped dielectric block having a top, a bottom and four sides, and including:

an antenna electrode pad on the block;

a transmit section extending between the antenna electrode and a first side of the block;

a receive section extending between the antenna electrode and a second side of the block opposing the first end;

each section having a plurality of through-hole resonators, each through-hole resonator extending between the top and the bottom;

a transmit electrode pad on the block and spaced apart from the antenna electrode along the length of the block and positioned in the transmit section;

a receive electrode pad on the block and spaced apart from the antenna electrode along the length of the block and positioned In the receive section;

a first isolated by-pass electrode plating on the block in the transmit section and having portions adjacent to at least three of the plurality of through-hole resonators of the transmit section; and a second Isolated by-pass electrode plating on the block in the receive section and having portions adjacent to at least three of the plurality of through-hole resonators of the receive section.

* * * * *